United States Patent [19]

Swenumson

[11] 4,133,148

[45] Jan. 9, 1979

[54] ROLL TOP GARAGE

[76] Inventor: Carrol J. Swenumson, Box 688, Moorcroft, Wyo. 82721

[21] Appl. No.: 874,042

[22] Filed: Feb. 1, 1978

[51] Int. Cl.[2] ..... E04B 1/342; E06B 3/48

[52] U.S. Cl. ..... 52/64; 160/114

[58] Field of Search ..... 52/64, 66, 68, 71, 86, 52/143; 160/114

[56] References Cited

U.S. PATENT DOCUMENTS

| | | | |
|---|---|---|---|
| 1,325,855 | 12/1919 | Norquist | 52/86 |
| 1,377,500 | 5/1921 | Nissen | 52/86 |
| 1,435,784 | 11/1922 | Arnold | 160/114 |
| 1,562,600 | 11/1925 | Taylor | 52/64 |
| 1,611,013 | 12/1926 | Francke | 160/114 |
| 3,600,866 | 8/1971 | Griffith | 52/143 |
| 4,004,382 | 1/1977 | Carlson | 52/64 |

*Primary Examiner*—James L. Ridgill, Jr.
*Attorney, Agent, or Firm*—Daniel Jay Tick

[57] ABSTRACT

An enclosure of sheet material has dimensions sufficient to accommodate an automotive vehicle and a cross-section of square U-shape configuration with spaced opposite first and second open ends. Guide devices are provided at the first and second ends. First and second roll units are slidably mounted in the first and second guide devices, respectively, for selectively opening and closing the openings of the ends of the enclosure independently from each other.

3 Claims, 5 Drawing Figures

ROLL TOP GARAGE

BACKGROUND OF THE INVENTION

The present invention relates to a roll top garage.

Structures similar to that described herein are disclosed in the following United States patents. U.S. Pat. No. 1,325,855, issued to Norquist on Dec. 23, 1919, U.S. Pat. No. 1,377,500, issued to Nissen on May 10, 1921, U.S. Pat. No. 1,562,600, issued to Taylor on Nov. 24, 1925, U.S. Pat. No. 3,600,866, issued to Griffith on Aug. 24, 1971, U.S. Pat. No. 3,667,172, issued to Erickson on June 6, 1972 and U.S. Pat. No. 4,004,382, issued to Carlson on Jan. 25, 1977.

Objects of the invention are to provide a roll top garage of simple structure, which is inexpensive in manufacture, installed with facility and convenience, without the need for a foundation, and functions efficiently, effectively and reliably as a convenient shelter for an automotive vehicle under circumstances in which a permanent garage is not feasible, such as, for example, for use with a mobile home in an area having inclement weather during part of the year.

BRIEF DESCRIPTION OF THE DRAWINGS:

In order that the invention may be readily carried into effect, it will now be described with reference to the accompanying drawings, wherein.

DETAILED DESCRIPTION OF THE INVENTION

The roll top garage of the invention comprises an enclosure 1 of sheet material of any suitable type such as, for example, sheet metal, plastic, or the like, having dimensions sufficient to accommodate an automotive vehicle (not shown in the FIGS.).

Figure 1:
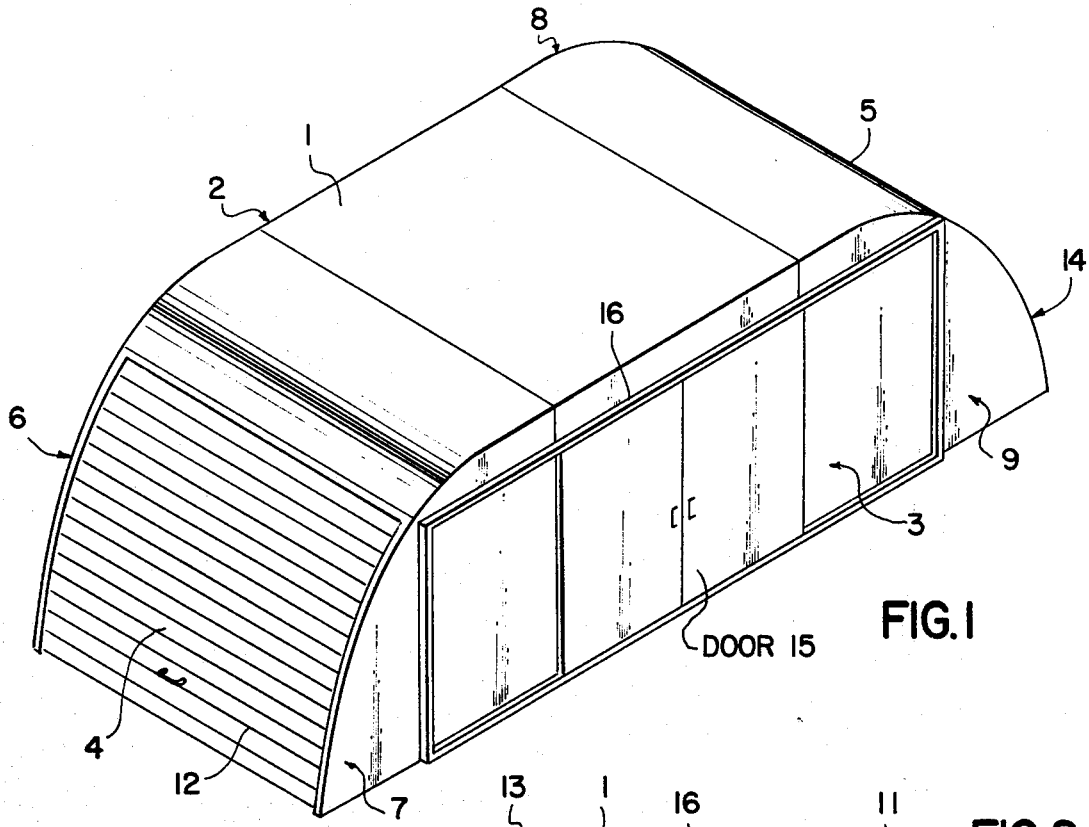
FIG. 1 is a perspective view of an embodiment of the roll top garage of the invention.
Figure 2:
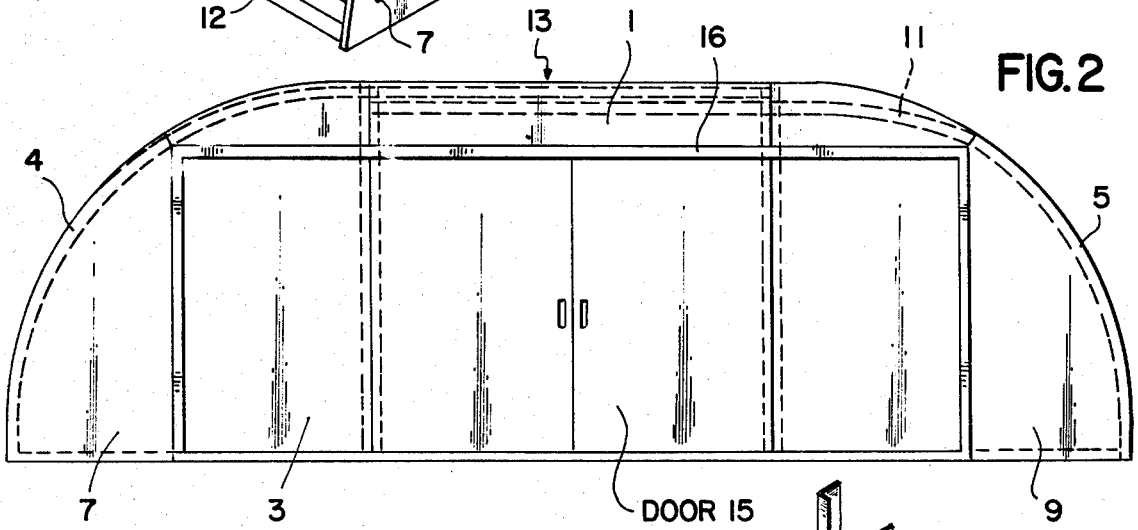
FIG. 2 is a side view, on an enlarged scale, of the embodiment of FIG. 1.
Figure 4:
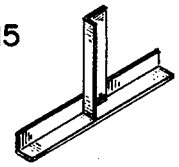
FIG. 4 is a perspective view, on an enlarged scale, of a structural joint of the roll top garage of the invention.

The enclosure 1 has a pair of spaced substantially parallel sides 2 and 3 (FIG. 1) and a cross-section of substantially square U configuration (not shown in the FIGS.). The enclosure 1 has spaced opposite first and second ends 4 and 5 (FIGS. 1 and 2). Each of the first and second ends 4 and 5 has an opening dimensioned to pass an automotive vehicle therethrough. The first end 4 is bounded by a pair of spaced substantially parallel sides 6 and 7 of substantially quadricircular configuration extending from the sides 2 and 3, respectively, of the enclosure 1 (FIG. 1). The second end 5 is bounded by a pair of spaced substantially parallel sides 8 and 9 of substantially quadricircular configuration extending from the sides 2 and 3, respectively, of the enclosure 1 (FIG. 1).

Figure 3:
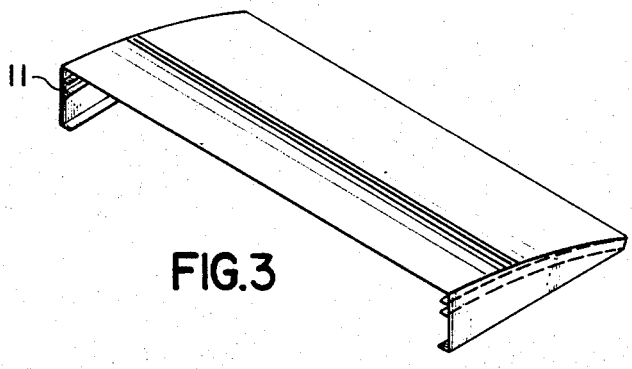
FIG. 3 is a perspective view, on an enlarged scale, of part of a guide device of the roll top garage of the invention.
Figure 5:
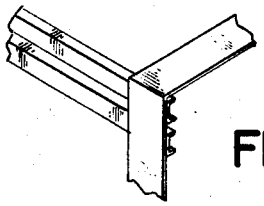
FIG. 5 is a perspective view, on an enlarged scale, of another structural joint of the roll top garage of the invention.

First and second guide devices are provided at the first and second ends 4 and 5, respectively, and are mounted on the inside surfaces of the sides 6 and 7 and 8 and 9 thereof. FIG. 2 shows the first guide device 10 mounted on the inside surfaces of the sides 6 and 7 of the first end 4, in broken lines. FIG. 2 also shows the second guide device 11 mounted on the inside surfaces of the sides 8 and 9 of the second end 5, in broken lines. FIG. 3 shows a part of the second guide device 11 in a perspective view. The first and second guide devices 10 and 11 are channels, tracks or rails for guiding roll units from positions in which they completely enclose the open ends of the enclosure 1 to positions in which they are completely spaced from such open ends, as shown in FIG. 2.

In accordance with the invention, a first roll unit 12 (FIG. 1) is slidably mounted in the first guide device 10 for selectively opening and closing the first end 4 of the enclosure independently from the second end 5 thereof. The first roll unit 12 is shown, in FIG. 1, in its position in which it completely encloses the first end 4 of the enclosure 1. In its raised position, the first roll unit 12 is positioned just beneath the top 13 (FIG. 2) of the enclosure 1, as indicated by broken lines. A second roll unit 14, not shown in the FIGS., but identical to the first roll unit 12, is slidably mounted in the second guide device 11 for selectively opening and closing the opening of the second end 5 of the enclosure 1 independently from the first roll unit 12. In its raised position, the second roll unit 14 is positioned beneath the first guide device 10 under the top 13 of the enclosure 1, as shown by broken lines in FIG. 2.

The two roll units permit a vehicle to be driven into the enclosure 1 via one of the ends thereof and driven out via one of the other ends thereof so that the vehicle is maneuverable with facility and convenience regardless of adverse weather conditions such as snow and ice.

In order to facilitate getting into a vehicle in the enclosure 1 and leaving a vehicle after is has been driven into said enclosure, an opening is provided in a side of the enclosure, and preferably in both sides 2 and 3 of said enclosure. As shown in FIGS. 1 and 2, a sliding door 15 is provided at the opening for selectively opening and closing said opening and is mounted substantially parallel to the side 3 of the enclosure. An identical sliding door is preferably provided on the side 2 of the enclosure 1. A door guide 16 (FIGS. 1 and 2) is provided on the side 3 for guiding the door 15 for movement in a plane substantially parallel to and next-adjacent the side 3. An identical door guide is preferably provided on the side 2 of the enclosure 1.

The enclosure 1 is secured to a supporting surface by any suitable means such as, for example, ground stakes, or the like (not shown in the FIGS.).

While the invention has been described by means of a specific example and in a specific embodiment, I do not wish to be limited thereto, for obvious modifications will occur to those skilled in the art without departing from the spirit and scope of the invention.

I claim:

1. A roll top garage, comprising an enclosure of sheet material having dimensions sufficient to accommodate an automotive vehicle, said enclosure having a pair of spaced substantially parallel sides, a cross-section of substantially square U configuration and spaced opposite first and second ends, each of the first and second ends having an opening dimensioned to pass an automotive vehicle therethrough and bounded by a pair of spaced substantially parallel sides of substantially quadricircular configuration extending from the sides of the enclosure;

first and second guide means each provided at a corresponding one of the first and second ends and mounted on the inside surfaces of the sides thereof; and first and second roll units each slidable mounted in a corresponding one of the first and second guide means for selectively opening and closing the openings of the first and second ends of the enclosure independently from each other.

2. A roll top garage as claimed in claim 1, wherein the enclosure has an opening in a side thereof and further comprising a door at said opening for selectively opening and closing said opening.

3. A roll top garage as claimed in claim 2, wherein the door is a sliding door mounted substantially parallel to the side of the enclosure, and further comprising door guiding means for guiding the door for movement in a plane substantially parallel to and next-adjacent said side.

* * * * *